US006383982B1

(12) United States Patent
Kida et al.

(10) Patent No.: US 6,383,982 B1
(45) Date of Patent: May 7, 2002

(54) COLOR DEVELOPER COMPOSITION, AQUEOUS DISPERSION, RECORDING SHEET AND COLOR DEVELOPING INK

(75) Inventors: Jotaro Kida, Chiba; Yoshimitsu Tanabe; Nobuhiro Takizawa, both of Kanagawa; Masakatsu Nakatsuka, Chiba, all of (JP)

(73) Assignee: Mitsui Chemicals, Inc. (JP)

( * ) Notice: Subject to any disclaimer, the term of this patent is extended or adjusted under 35 U.S.C. 154(b) by 0 days.

(21) Appl. No.: 09/563,240

(22) Filed: May 2, 2000

(30) Foreign Application Priority Data

May 11, 1999 (JP) ..... 11-129771

(51) Int. Cl.[7] ..... B41M 5/155

(52) U.S. Cl. ..... 503/210; 106/31.17; 503/211; 503/212; 503/214; 503/216

(58) Field of Search ..... 503/216, 214, 503/210–212

(56) References Cited

U.S. PATENT DOCUMENTS 4,623,557 A * 11/1986 Yamori et al. ..... 427/44

* cited by examiner

*Primary Examiner*—Bruce H. Hess
(74) *Attorney, Agent, or Firm*—Burns, Doane, Swecker & Mathis, L.L.P.

(57) ABSTRACT

A color developer composition comprising (A) a color developer containing a polyvalent metal salt of a salicylic acid derivative, and (B) a polyester polyol having in the molecule skeleton at least one carbonate bond or ester bond, and a derivative thereof, an aqueous dispersion and a color developing ink using this color developer composition, and a recording sheet having a layer containing this color developer composition on a base material.

18 Claims, 2 Drawing Sheets

COLOR DEVELOPER COMPOSITION, AQUEOUS DISPERSION, RECORDING SHEET AND COLOR DEVELOPING INK

BACKGROUND OF THE INVENTION

1. Field of the Invention

The present invention relates to a color developer composition, and an aqueous dispersion, recording sheet and color developing ink obtained by using the same.

2. Description of the Related Art

Examples of pressure-sensitive recording sheets include an upper sheet prepared by applying on one surface of a base material microcapsules comprising therein a capsule oil dissolving an electron donative developing compound (color former) and the like, an intermediate sheet prepared by applying on one surface of a base material a color developer (electron receptive compound) which develops color in contact with an electron donative developing compound and by applying on the opposite surface microcapsules, and a lower sheet prepared by applying on one surface of a base material a developer, and in general, they are used in a combination of upper sheet-lower sheet or upper sheet-intermediate sheet-lower sheet.

Further, there is also a copy sheet in the form of a single body which can effect copying with a single sheet, prepared by applying on the same surface of a base material microcapsules and a color developer.

Conventionally, salicylic acid derivatives, for example, polyvalent metal salts of 3,5-disubstituted salicylic acid derivatives (e.g., Japanese Patent Publication (JP-B) No. 51-25174), or polyvalent metal salts of a salicylic acid resin obtained by reacting salicylates with styrenes to obtain salicylate resins, hydrolyzing the salicylate resins, then, allowing polyvalent metal compounds to act on the hydrolyzates (Japanese Patent Application Laid-Open (JP-A) No. 1-133780), have been known to be useful as a developer (electron receptive compound) for a pressure-sensitive recording sheet.

However, these pressure-sensitive recording sheets containing a polyvalent metal salt of a salicylic acid derivative as a color developer have problems that color developing speed, particularly color developing speed at lower temperature environment is slow, and a longer period of time is necessary for obtaining a recording image having practically sufficient color-developed concentration.

For solving these problems, various trials have been suggested. For example, a composition containing a metal salt of an aromatic carboxylic acid, and a. carboxylic amide (JP-A No. 2-215582), a composition obtained by dissolving a polyvalent metal salt of a salicylic acid derivative into vegetable oil and an organic solvent having a boiling point of 200° C. or lower, and emulsifying the solution in water (JP-A No. 4-52184), a composition composed of a polyvalent metal salt of a salicylic acid derivative, and a polyoxyalkylene or derivative thereof (JP-A No. 6-15951) and the like have been suggested.

However, it can not be admitted that the color developing speed of a color developer obtained by these known methods, particularly, the color developing speed at lower temperature is satisfactory. Further, when a color developer prepared by using known methods is treated in the form of an aqueous dispersion, there are problems that dispersion stability is often poor, precipitation and aggregation occur.

SUMMARY OF THE INVENTION

An object of the present invention is to provide a color developer composition which has excellent dispersion stability and manifests excellent color developing speed, and an aqueous dispersion, recording sheet and color developing ink obtained by using the same.

The present inventors have intensively investigated a color developer composition, and an aqueous dispersion, recording sheet and color developing ink thereof and resultantly completed the present invention. Namely, the present invention relates to (i) A color developer composition comprising (A) a color developer containing a polyvalent metal salt of a salicylic acid derivative, and (B) a polyester polyol having in the molecule skeleton at least one carbonate bond or ester bond, and a derivative thereof;

(ii) The color developer composition according to (i) wherein the polyester polyol and derivative thereof is a polycarbonate diol or lactone-based polyester polyol;

(iii) The color developer composition according to (i) or (ii) wherein the content of the component (B) is from 1 to 25 parts by weight based on 100 parts by weight of the component (A);

(iv) An aqueous dispersion of a color developer composition prepared by dispersing a color developer composition according to any of (i) to (iii) in water;

(v) A recording sheet having on a base material a layer containing a color developer composition according to any of (i) to (iii);

(vi) A recording sheet obtained by applying on a base material a coating solution prepared by using an aqueous dispersion of a color developer composition according to (iv);

(vii) A color developing ink comprising a color developer, photocurable compound, photopolymerizing agent and pigment wherein the color developer is a color developer composition according to any of (i) to (iii); and (viii) A recording sheet obtained by printing using a color developing ink according to (vii) on a base material.

It has become possible, according the present invention, to provide a color developer composition, aqueous dispersion, recording sheet and color developing ink, having excellent dispersion stability and manifesting excellent color developing speed.

DETAILED DESCRIPTION OF THE PREFERRED EMBODIMENTS

Figure 1:
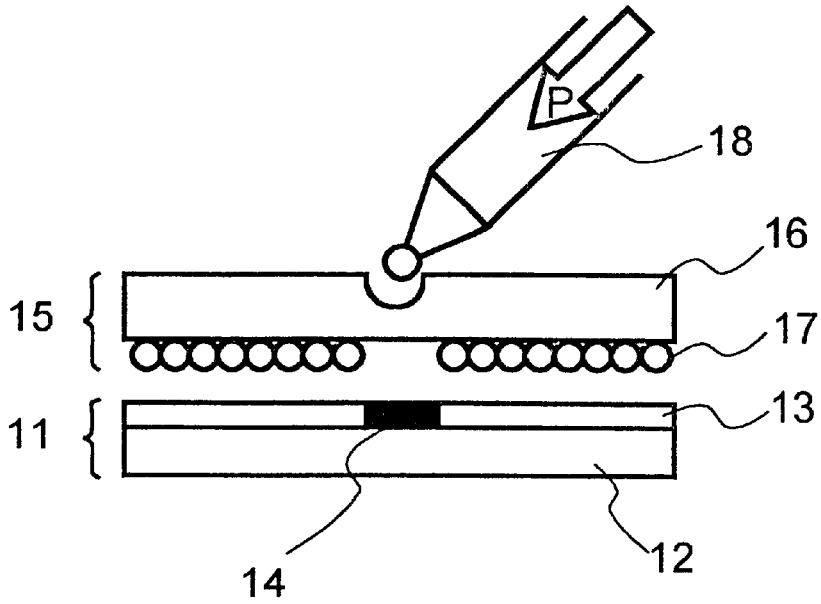
FIG. 1 is a schematic configuration view of one example of a pressure-sensitive recording sheet.

The color developer composition, aqueous dispersion, recording sheet and color developing ink of the present invention will be described in detail below.

The color developer composition of the present invention comprises a component (A): a color developer containing a polyvalent metal salt of a salicylic acid derivative, and a component (B): a polyester polyol having in the molecule skeleton at least one carbonate bond or ester bond, and a derivative thereof.

As the polyvalent metal salt of a salicylic acid derivative which is a component of the component (A) of the present invention, there are preferably exemplified polyvalent metal salts of salicylic acid derivatives represented by the general formula (1):

(1)

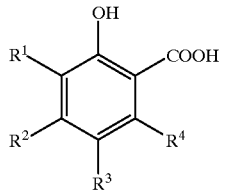

wherein, $R^1$ to $R^4$ are each independently a hydrogen atom, halogen atom, alkyl group, alkoxy group, aralkyl group or aryl group, and adjacent two groups of $R^1$ to $R^4$ may bond to form a ring.

Preferable examples of $R^1$ to $R^4$ include a hydrogen atom, fluorine atom, chlorine atom, bromine atom, alkyl group having 1 to 20 carbon atoms, alkoxy group having 1 to 20 carbon atoms, aralkyl group which may have a substituent having a total carbon number of 7 to 20, or aryl group which may have a substituent having a total carbon number of 6 to 20.

Specific examples of the polyvalent metal salt of a salicylic acid derivative of the present invention include polyvalent metal salts of salicylic acid, 3-methylsalicylic acid, 6-ethylsalicylic acid, 5-isopropylsalicylic acid, 5-sec-butylsalicylic acid, 5-tert-butylsalicylic acid, 5-tert-amylsalicylic acid, 5-cyclohexylsalicylic acid, 5-n-octylsalicylic acid, 5-tert-octylsalicylic acid, 5-isononylsalicylic acid, 3-isododecylsalicylic acid, 5-isododecylsalicylic acid, 5-isopentadecylsalicylic acid, 4-methoxysalicylic acid, 6-methoxysalicylic acid, 5-ethoxysalicylic acid, 6-isopropoxysalicylic acid, 4-n-hexyloxylsalicylic acid, 4-n-decyloxylsalicylic acid, 3,5-di-tert-butylsalicylic acid, 3,5-di-tert-octylsalicylic acid, 3,5-diisononylsalicylic acid, 3,5-diisododecylsalicylic acid, 3-methyl-5-tert-nonylsalicylic acid, 3-tert-butyl-5-isononylsalicylic acid, 3-isononyl-5-tert-butylsalicylic acid, 3-isododecyl-5-tert-butylsalicylic acid, 3-isononyl-5-tert-amylsalicylic acid, 3-isononyl-5-tert-octylsalicylic acid, 3-isononyl-6-methylsalicylic acid, 3-isododecyl-6-methylsalicylic acid, 3-sec-octyl-5-methylsalicylic acid, 3-isononyl-5-phenylsalicylic acid, 3-phenyl-5-isononylsalicylic acid, 3-methyl-5-(α-methylbenzyl) salicylic acid, 3-methyl-5-(α,α-dimethylbenzyl)salicylic acid, 3-isononyl-5-(α-methylbenzyl)salicylic acid, 3-(α-methylbenzyl)-5-tert-butylsalicylic acid, 3-benzylsalicylic acid, 5-benzylsalicylic acid, 3-(α-methylbenzyl)salicylic acid, 5-(α-methylbenzyl)salicylic acid, 3-(α,α-dimethylbenzyl)salicylic acid, 4-(α,α-dimethylbenzyl) salicylic acid, 5-(α,α-dimethylbenzyl)salicylic acid, 3,5-di (α-methylbenzyl)salicylic acid, 3,5-di(α,α-dimethylbenzyl) salicylic acid, 3-(α-methylbenzyl)-5-(α,α-dimethylbenzyl) salicylic acid, 3-(1',3'-diphenylbutyl)salicylic acid, 5-(1',3'-diphenylbutyl)salicylic acid, 3-[α-methyl-4'-(α'-methylbenzyl)benzyl]-salicylic acid, 5-[α-methyl-4'-(α'-methylbenzyl)benzyl]-salicylic acid, 3-(α-methylbenzyl)-5-(1',3'-diphenyl-butyl)salicylic acid, 3-(1',3'-diphenylbutyl)-5-(α-methylbenzyl)salicylic acid, 3-phenylsalicylic acid, 5-phenylsalicylic acid, 3-(α-methylbenzyl)-5-phenylsalicylic acid, 3-(α,α-dimethylbenzyl)-5-phenylsalicylic acid, 3-phenyl-5-(α-methylbenzyl)salicylic acid, 5-(4'-methylphenyl)salicylic acid, 5-(4'-methoxyphenyl)salicylic acid, 5-fluorosalicylic acid, 3-chlorosalicylic acid, 4-chlorosalicylic acid, 5-chlorosalicylic acid, 5-bromosalicylic acid, 3-chloro-5-(α-methylbenzyl)salicylic acid, 3-(α-methylbenzyl)-5-chlorosalicylic acid, and the like.

Further, examples of the polyvalent metal salt of a salicylic acid derivative of the present invention, other than the above-described salts, include polyvalent metal salts of 2-hydroxy-1-benzyl-3-naphthoic acid, 2-hydroxy-3-(α,α-dimethylbenzyl)-1-naphthoic acid, 3-hydroxy-7-(α,α-dimethylbenzyl)-2-naphthoic acid, further, carboxy-modified terpene-phenol resins described in JP-A No. 62-19486, polystyrenated salicylic acid resin derivatives described in JP-A Nos. 63-112537, 63-186729, 1-133780 and the like, polybenzylated styrenated salicylic acid resin derivatives described in JP-A No. 2-160815, and the like.

In the above-mentioned salicylic acid derivatives, the isononyl group, isododecyl group, and isopentadecyl group are generic names for substituents generated by addition of a propylene trimer, propylene tetramer or 1-butene trimer, and propylene pentamer, respectively.

The above-mentioned salicylic acid derivatives are partially available commercially, and can be obtained, for example, from phenol derivatives by Kolbe-Schmitt reaction.

As the specific examples of the polyvalent metal, magnesium, zinc, nickel, aluminum and calcium are listed, and zinc is particularly preferable.

These polyvalent metal salts of salicylic acid derivatives may be used alone, or in combination of two or more. Further, polyvalent metal salts of a mixture of salicylic acid derivatives which are obtained by polyvalent metal salt-formation using a plurality of salicylic acid derivatives may also permissible.

There is no specific restriction to a method for producing the polyvalent metal salt of a salicylic acid derivative of the present invention, and known methods can be applied. There are applied, for example, (I) a method in which one or more salicylic acid derivatives and a polyvalent metal compound (for example, oxides, hydroxides, carbonates, silicate or organic carboxylates of polyvalent metals) are melted to produce salts (melting method), (II) a method in which water-soluble salicylic acid derivative salts such as alkali metal salts, amine salts or ammonium salts of one or more salicylic acid derivatives are reacted with a water-soluble polyvalent metal compound (for example, sulfates such as zinc sulfate, magnesium sulfate and aluminum sulfate, chlorides such as zinc chloride, magnesium chloride, calcium chloride, nickel chloride and aluminum chloride, acetates such as zinc acetate) in the presence of water to produce salts (double decomposition method), as well as other methods.

The polyvalent metal salt of a salicylic acid derivative of the present invention may sometimes form a hydrate, and in the present specification, the polyvalent metal salt of a salicylic acid derivative also include such hydrates.

The component (B) according to the present invention includes a polyester polyol having in the molecule skeleton at least one carbonate bond or ester bond, and a derivative thereof.

As the polyester polyol having in the molecule skeleton at least one carbonate bond or ester bond, which is the component (B) of the present invention, there are exemplified carbonate diols, lactone-based polyester polyols, condensed polyester polyols, and the like.

Disclosed as examples of the polycarbonate diols, which are one embodiment of the component (B) of the present invention, are polyethylene carbonate diol, polypropylene carbonate diol, polytetramethylene carbonate diol, polypentamethylene carbonate diol, polyhexamethylene carbonate diol, polyheptamethylene carbonate diol, or polycarbonate diols obtained by substituting an alkoxy group, acyloxy group and the like for the end groups of these polycarbonate diols, and the like. These polycarbonate diols may be used alone, or in combination of two or more.

The average molecular weight of the polycarbonate diol according to the present invention is generally from about 500 to 30000, preferably from about 600 to 10000, more preferably from about 700 to 5000, particularly preferably from about 800 to 4000.

As the lactone-based polyester polyol which is one embodiment of the component (B) of the present invention, there are exemplified those obtained by ring-open polymerization of caprolactones using a polyvalent alcohol as an initiator. Examples of the caprolactone include γ-butyrolactone, δ-valerolactone and ε-caprolactone. Examples of the polyvalent alcohol used as an initiator include ethylene glycol, propylene glycol, butanediol, hexanediol, neopentyl glycol, diethylene glycol, triethylene glycol, pentanediol, cyclohexanediol, glycerine, trimethylolpropane, trimethylolethane, pentaerythritol, polyethylene ether glycol, polypropylene ether glycol, polybutylene ether glycol, polytetramethylene ether glycol, polypentamethylene ether glycol and polyhexamethylene ether glycol. Further, lactone-based polyester polyols obtained by substituting an alkoxy group, acyloxy group and the like for the end groups of these lactone-based polyester polyols, are listed. These lactone-based polyester polyols may be used alone or in combination of two or more.

The average molecular weight of the lactone-based polyester polyol according to the present invention is generally from about 500 to 30000, preferably from about 600 to 10000, more preferably from about 700 to 5000, particularly preferably from about 800 to 4000.

As the condensed polyester polyol which is one embodiment of the component (B) of the present invention, there are exemplified those obtained by polycondensation of a dicarboxylic acid with a polyvalent alcohol. Examples of the dicarboxylic acid include adipic acid, o-phthalic acid, m-phthalic acid, p-phthalic acid, succinic acid, azelaic acid, suberic acid, ricinoleic acid and the like. Examples of the polyvalent alcohol include ethylene glycol, propylene glycol, butanediol, hexanediol, neopentyl glycol, diethylene glycol, triethylene glycol, pentanediol, cyclohexanediol, glycerine, trimethylolpropane, trimethylolethane, pentaerythritol and the like. Further, condensed polyester polyols obtained by substituting an alkoxy group, acyloxy group and the like for the end groups of these condensed type polyester polyols, are listed. These condensed polyester polyols may be used alone or in combination of two or more.

The average molecular weight of the condensed polyester polyol according to the present invention is generally from about 500 to 30000, preferably from about 600 to 10000, more preferably from about 700 to 5000, particularly preferably from about 800 to 4000.

These polycarbonate diols, lactone-based polyester polyols, or condensed polyester polyols may be used together.

The color developer composition of the present invention is a color developer composition comprising (A) a color developer containing a polyvalent metal salt of a salicylic acid derivative, and (B) a polyester polyol having in the molecule skeleton at least one carbonate bond or ester bond, and a derivative thereof, and though there is no specific restriction to the composition thereof, and the total amount of a polyester polyol having in the molecule skeleton at least one carbonate bond or ester bond, and a derivative thereof included in the component (B) is generally from about 1 to 100 parts by weight, preferably from 1 to 40 parts by weight, more preferably from 1 to 25 parts by weight based on 100 parts by weight of a color developer containing a polyvalent metal salt of a salicylic acid derivative as the component (A).

For preparing the color developer composition of the present invention, for example, the component (B) may be added directly to the component (A), a color developer containing a polyvalent metal salt of a salicylic acid derivative, or the component (B) may be added to an aqueous dispersion of the component (A).

When the component (B) is added to an aqueous dispersion of the component (A), an aqueous dispersion of a color developer containing a polyvalent metal salt of a salicylic acid derivative may be prepared before compounding of the component (B) to the dispersion, or in preparing an aqueous dispersion of a color developer containing a polyvalent metal salt of a salicylic acid derivative, the component (B) may be dispersed together with the color developer (emulsion-dispersion).

In a more preferable method, in preparing an aqueous dispersion of the component (A), a color developer containing a polyvalent metal salt of a salicylic acid derivative, the component (B) is dispersed together with the color developer (emulsion-dispersion).

The color developer composition of the present invention is a color developer composition comprising (A) a color developer containing a polyvalent metal salt of a salicylic acid derivative, and (B) a polyester polyol having in the molecule skeleton at least one carbonate bond or ester bond, and a derivative thereof, and further, there may be a preferable case in which a color developer composition having further improved color developing speed under lower temperature environment can be obtained by inclusion of an oligomer of a styrene derivative, preferably an oligomer of 2 to 20 styrene derivatives.

This oligomer may be a linear oligomer (for example, linear dimer of styrene, 1,3-diphenyl-1-butene), or a cyclic oligomer (for example, cyclic dimer of styrene, 1-methyl-3-phenyl-indane), or also a mixture thereof.

To the color developer composition of the present invention, known color developers (e.g., acid clay minerals such as acid clay, activated clay, attapulgite and bentonite, phenols-formaldehyde condensate, phenols salicylic acids-formaldehyde condensate, or polyvalent metal salts of these condensates, and the like) may also be added, if necessary.

Further, the color developer composition of the present invention may contain various additives such as ultraviolet absorber, antioxidant and light stabilizer, if necessary.

Examples of the ultraviolet absorber which can be used in the color developer composition of the present invention include benzophenone derivatives such as 2,4-dihydroxybenzophenone, 2-hydroxy-4-methoxybenzophenone, 2-hydroxy-4-dodecyloxybenzophenone, benzotriazole derivatives such as 2-(2'-hydroxy-5'-methylphenyl)benzotriazole, 2-(2'-hydroxyl-5'-tert-butylphenyl)benzotriazole, 2-(2'-hydroxyl-3',5'-di-tert-butylphenyl)benzotriazole, cyano acrylate derivatives such as 2-ethylhexyl-2-cyano-3,3'-diphenyl acrylate and ethyl-2-cyano-3,3'-diphenyl acrylate.

The amount of the ultraviolet absorber contained in the color developer composition of the present invention is generally from 0.1 to 30 parts by weight, preferably from 1 to 20 parts by weight based on 100 parts by weight of the color developer (A) containing a polyvalent metal salt of a salicylic acid derivative.

Examples of the antioxidant include phenol derivatives such as 2,6-di-tert-butylphenol, 2,6-diisopropyl-4-methylphenol, 2,6-di-tert-butyl-4-methylphenol, 2-tert-butyl-4-methoxyphenol, 2,5-di-tert-octyl-4-methoxyphenol, 2,5-di-tert-butylhydroquinone, 2,5-di-tert-octylhydroquinone, 1,1,3-tris(2'-methyl-4'-hydroxy-5'-tert-butylphenyl)butane, 1,1,3-tris(2'-methyl-4'-hydroxy-5'-cyclohexylphenyl)butane, 1,1,3-tris(2'-ethyl-4'-hydroxy-5'-tert-butylphenyl)butane, 1,1,3-tris(3',5'-di-tert-butyl-4'-hydroxyphenyl)butane, 1,1,3-tris(2'-methyl-4'-hydroxy-5'-tert-butylphenyl)propane, 1,1-bis(2'-methyl-5'-tert-butyl-4'-hydroxyphenyl)butane, tetrakis[methylene-3-(3',5'-di-tert-butyl-4'-hydroxyphenyl)propionate]methane, bis(3-tert-butyl-5-methyl-2-hydroxyphenyl)methane, bis(3-tert-butyl-5-ethyl-2-hydroxyphenyl)methane, 1,3,5-trimethyl-2,4,6-tris(3',5'-di-tert-butyl-4'-hydroxybenzyl)benzene, 1,3,5-tris(4'-tert-butyl-3'-hydroxy-2',6'-dimethylbenzyl)isocyanuric acid, 1,3,5-tris(4'-tert-butyl-3'-hydroxy-2'-methyl-6'-ethylbenzyl)isocyanuric acid and bis(2-methyl-4-hydroxy-5-tert-butylphenyl)sulfide.

The amount of the antioxidant contained in the color developer composition of the present invention is generally from 0.1 to 30 parts by weight, preferably from 1 to 20 parts by weight based on 100 parts by weight of the component (A).

Examples of the light stabilizer include hindered amine derivatives such as 2,2,4-trimethyl-1,2-dihydroquinoline polymer, 6-ethoxy-2,2,4-trimethyl-1,2-dihydroquinoline, 4-benzyloxy-2,2,6,6-tetramethylpiperidine and bis(2,2,6,6-tetramethylpiperidine)adipate.

The amount of the light stabilizer contained in the color developer composition of the present invention is generally from 0.1 to 30 parts by weight, preferably from 1 to 20 parts by weight based on 100 parts by weight of the component (A).

These various additives may be added directly to the color developer composition, or may be added to an aqueous dispersion of the color developer composition of the present invention discussed later. In the case of addition to an aqueous dispersion, an aqueous dispersion of the color developer composition of the present invention may be prepared before compounding the additive into the aqueous dispersion, or in preparing an aqueous dispersion of the color developer composition, the additive may be dispersed together with the color developer composition (emulsion-dispersion), and more preferably, in preparing an aqueous dispersion of the color developer composition, the additive is dispersed together with the color developer composition (emulsion-dispersion).

The color developer composition of the present invention is generally used in the form of an aqueous dispersion, coating solution obtained by using an aqueous dispersion, and the like. An aqueous dispersion of the color developer composition of the present invention is applied as it is or in the form of a coating solution, onto a base material to form a layer of the color developer composition to be used as a recording sheet.

As the method for preparing an aqueous dispersion of the color developer composition of the present invention, there are exemplified:

(I) a method in which a color developer composition is ground and dispersed in a water medium using, for example, a ball mill, attritor, sand grinder, pebble mill, cobble mill, dyno mill, high speed impeller disperser, high speed stone mill, annular mill and the like, to obtain an aqueous dispersion;

(II) a method in which a color developer composition is dissolved in an organic solvent, then, the solution is emulsion-dispersed in a water medium using, for example, an ultrasonic disperser, homogenizer, homomixer, line homomixer and the like, and the organic solvent is removed to obtain an aqueous solution;

as well as other methods.

The method (II) in which an aqueous dispersion is prepared by emulsion-dispersion is more preferable method.

Preparation of an aqueous solution of a color developer composition is generally conducted in a water medium in the presence of a dispersing agent.

As the dispersing agent used in dispersing in a water medium, ionic or nonionic surfactants are preferable, and examples thereof include synthetic or natural polymer compounds such as polyvinyl alcohol, alkyl-modified polyvinyl alcohol, cyanoethyl-modified polyvinyl alcohol, ether-modified polyvinyl alcohol, sulfonated polyvinyl alcohol, polyacrylamide, polyacrylic acid, acrylamide-alkyl acrylate copolymer, alkali metal salt of polystyrenesulfonic acid, maleic anhydride-isobutyrene copolymer, carboxymethylcellulose, hydroxyethylcellulose, polyvinylpyrrolidone, starch and derivatives thereof, casein, gum arabic, agar, gelatin and the like, alkali metal salts of alkylbenzenesulfonic acids, alkali metal salts of alkylnaphthalenesulfonic acids, alkali metal salts of dialkylsulfosuccinic acids, alkali metal salts of alkylsulfonic acids, polyoxyethylene alkyl ethers, polyoxyethylene alkylphenyl ethers, polyhydric alcohol fatty acid esters, and the like. Polyvinyl alcohol, alkyl-modified polyvinyl alcohol, cyanoethyl-modified polyvinyl alcohol, ether-modified polyvinyl alcohol, sulfonated polyvinyl alcohol, alkali metal salts of polystyrenesulfonic acid, alkali metal salts of alkylsulfonic acids are preferable, polyvinyl alcohol is more preferable, and polyvinyl alcohol having a saponification degree of 80 to 100% is particularly preferable. These dispersing agents may be used alone or in combination of two or more.

The use amount of the dispersing agent is not particularly restricted, and in general, for example from about 1 to 30 parts by weight, more preferably from about 1 to 20 parts by weight, more preferably from about 1 to 15 parts by weight, particularly preferably from about 1 to 10 parts by weight, based on 100 parts by weight of a color developer composition containing a polyvalent metal salt of a salicylic acid derivative.

In the above-mentioned method (II), as the organic solvent used, those having smaller solubility in water, excellent property for dissolving a color developer composition, and relatively lower boiling point are preferable.

Examples of the organic solvent include hydrocarbon solvents such as benzene, toluene, xylene, ethylbenzene and 1-methylnaphthalene, halogenated hydrocarbon solvents such as dichloromethane, chloroform, tetrachloroethylene, 1,2-dichloroethane, 1,1,1-trichloroethane, 1,1,2-trichloroethane, 1,1,2,2-tetrachloroethane, chlorobenzene, o-dichlorobenzene, m-dichlorobenzene, p-dichlorobenzene, o-chlorotoluene, m-chlorotoluene and p-chlorotoluene, ketone solvents such as methyl ethyl ketone, methyl isobutyl ketone and cyclohexanone, ester solvents such as ethyl acetate, butyl acetate and amyl acetate, alcohol solvents such as butanol, pentanol, hexanol and cyclohexanol, as well as other solvents. These solvents may be used alone or in combination of two or more.

The use amount of the organic solvent is not particularly restricted, and in general, for example, from about 5 to 500 parts by weight, more preferably from about 20 to 300 parts by weight based on 100 parts by weight of a color developer composition containing a polyvalent metal salt of a salicylic acid derivative.

The emulsion-dispersion is conducted at a temperature of not more than the boiling point of an organic solvent, and effected under atmospheric pressure or positive pressure. After the emulsion-dispersion, an organic solvent is distilled off to obtain an aqueous dispersion of a color developer composition. For distilling off an organic solvent, the organic solvent can be distilled off by heating at a temperature not lower than the boiling point of the organic solvent under atmospheric pressure or reduced pressure. Thus obtained aqueous dispersion can also be dispersed further using a disperser (for example, sand grinder, annular mill and the like), if necessary.

In the aqueous dispersion of the present invention, the concentration of solid components is 55% by weight or less, preferably 50% by weight or less.

The average particle size of a color developer composition in the aqueous dispersion of the present invention is generally 10 $\mu$m or less, preferably from about 0.1 to 5 $\mu$m, more preferably from about 0.2 to 3 $\mu$m, particularly preferably from about 0.3 to 2 $\mu$m.

The aqueous dispersion of the color developer composition of the present invention may further contain a binder (binding agent), pigment and the like in addition to the color developer composition to provide a solution which can be used as a coating solution. This coating solution may also contain various additives such as a de-foaming agent, pH regulating agent and viscosity controlling agent, if necessary.

When the aqueous dispersion of a color developer composition of the present invention is used as a coating solution, the content of solid components in the coating solution is from about 10 to 60% by weight, preferably from about 15 to 50% by weight.

The binder is not particularly restricted, and examples thereof include synthetic or natural polymer compounds such as polyvinyl alcohol, casein, starch and derivatives thereof, gum arabic, methylcellulose, carboxymethylcellulose, polyacrylic acid, and latices such as styrene-butadiene copolymer latex and acrylic acid latex. The binder may be used alone or in combination of two or more.

The use amount of the binder is not particularly restricted, and in general, from about 3 to 40% by weight, preferably from about 5 to 30% by weight based on the total solid content in the coating solution.

The pigment is not particularly restricted, and examples thereof include inorganic pigments such as zinc oxide, zinc carbonate, calcium carbonate, magnesium carbonate, barium carbonate, magnesium sulfate, barium sulfate, titanium oxide, talc, kaolin, activated clay, diatomaceous earth, zinc hydroxide, aluminum hydroxide, magnesium hydroxide, alumina and silica, organic pigments such as styrene-microball, nylon particle, urea-formalin filler, polyethylene particle, cellulose filler and starch particle.

The pigment may be used alone or in combination of two or more.

The use amount of the pigment is not particularly restricted, and in general, from about 5 to 90% by weight, preferably from about 10 to 85% by weight based on the total solid content in the coating solution.

Thus prepared coating solution obtained by using an aqueous dispersion of a color developer composition of the present invention can be applied on a base material such as paper, plastic sheet, synthetic paper, or composite sheets made by combining them by an application apparatus such as, for example, an air knife coater, blade coater, roll coater, size press coater, curtain coater and short dwell coater according to a known method, and dried to form a layer of the color developer, manufacturing a recording sheet.

In the recording sheet of the present invention, the weight of a layer of a color developer composition on a base material (namely, application amount) is not particularly restricted, and in general, is 0.5 g/m$^2$ or more, preferably from about 0.5 to 10 g/m$^2$.

The form of the recording sheet of the present invention is not particularly restricted, and there are exemplified pressure-sensitive recording sheets, heat-sensitive recording sheets, heat-sensitive multiple copying sheets described in JP-A No. 10-166723, and the like. Pressure-sensitive recording sheets are more preferable.

Figure 2:
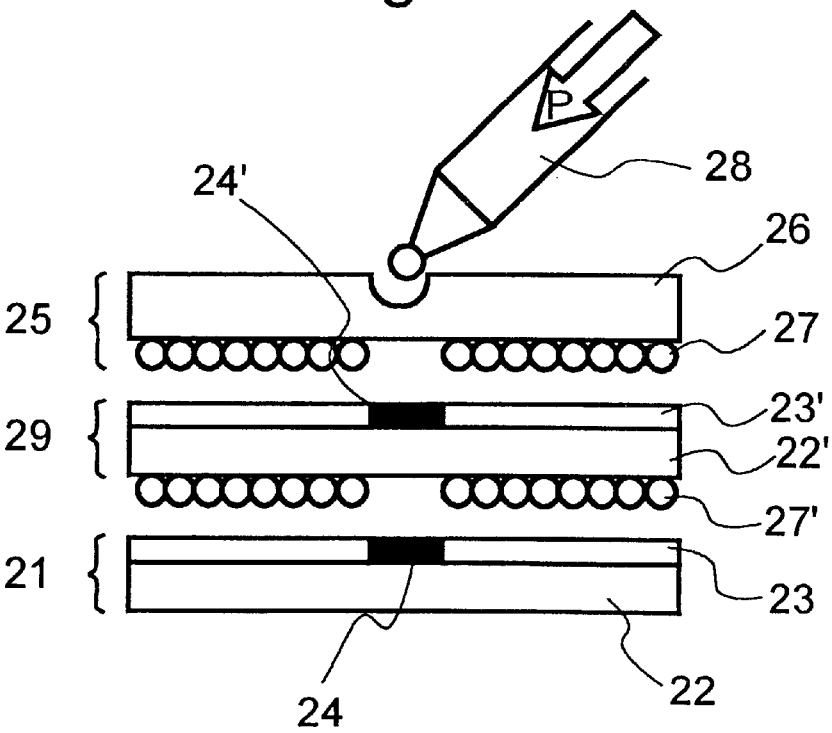
FIG. 2 is a schematic configuration view of another example of a pressure-sensitive recording sheet.
Figure 3:
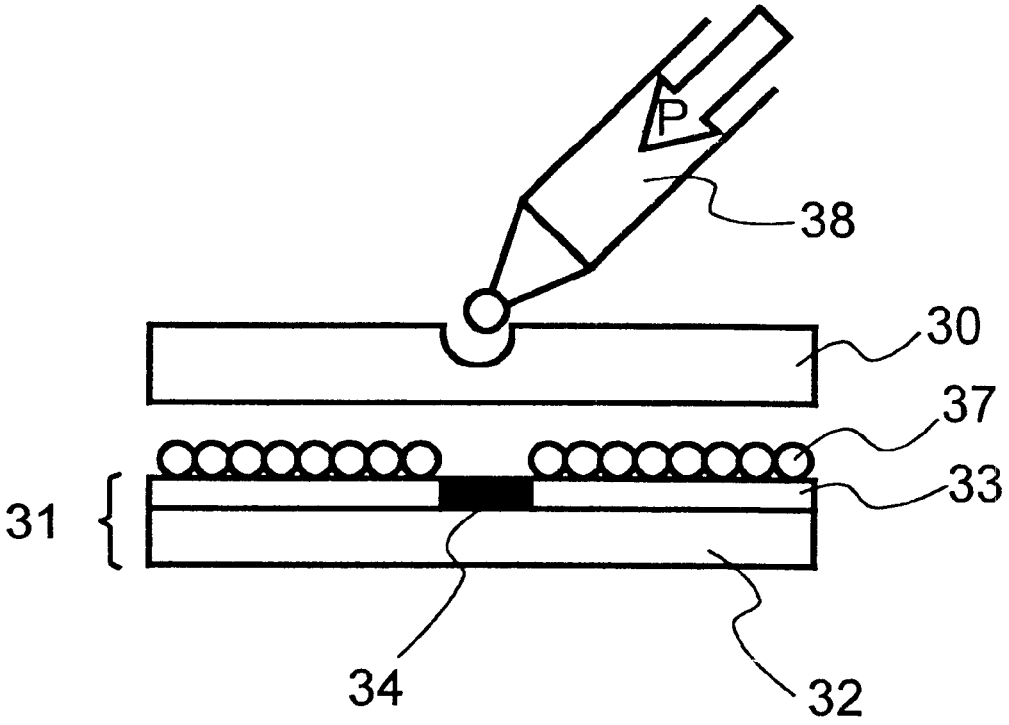
FIG. 3 is a schematic configuration view of further another example of a pressure-sensitive recording sheet.

As the pressure-sensitive recording sheet, there are exemplified (I) a lower sheet 11 composed of a base sheet 12 and a color developer composition layer 13 provided on the base sheet 12, used in combination with an upper sheet 15 composed of a sheet 16 and microcapsules 17 containing therein an electron-donative color developing compound and a capsule oil, applied on one surface of the sheet 16, wherein a pressure (P) is applied by a pressure means 18 (for example, writing instrument, typewriter and dot-impact-printer) to destruct the microcapsule 17 on the upper sheet 15 to cause transfer of the electron-donative color developing compound in the capsule to the color developer composition layer 13, giving rise to reaction thereof to obtain a recorded image 14 (FIG. 1);

(II) an upper sheet 25 composed of a sheet 26 and microcapsules 27 containing therein an electron-donative color developing compound and a capsule oil applied on one surface of the sheet 26, a lower sheet 21 composed of a base sheet 22 and a color developer composition layer 23 provided on the sheet 22, and an intermediate sheet 29 composed of a color developer composition layer 23' provided on one surface of a sheet 22' and a microcapsule layer 27' provided on the opposite surface of the sheet 22', the intermediate sheet 29 being inserted between the upper sheet 25 and the lower sheet 21, wherein a pressure (P) is applied by a pressure means 28 (for example, writing instrument, typewriter and dot-impact-printer) to destruct the microcapsule 27 on the upper sheet 25 to cause transfer of the electron-donative color developing compound in the capsule to the color developer composition layer 23' of the intermediate sheet 29, giving rise to reaction thereof to obtain a recorded image 24', and further to destruct the microcapsule 27' on the intermediate sheet 29 to cause transfer of the electron-donative color developing compound in the capsule to the color developer composition layer 23 of the lower sheet 21, giving rise to reaction thereof to obtain a recorded image 24 (FIG. 2); and further, (III) a single body copy sheet 31 composed of a base sheet 32 and, microcapsules 37 and a color developer composition layer 33 applied on the same surface of the sheet 32, wherein a pressure (P) is applied to an original sheet 30 by a pressure means 38 (for example, writing instrument, typewriter and dot-impact-printer) to destruct the microcapsule 37 on the single body copy sheet 31 to cause reaction of an electron-donative color developing compound in the capsule with a color developer in the color developer composition layer to obtain a recorded image 34 (FIG. 3), as well as other pressure-sensitive recording sheets.

The microcapsule can be produced by known various micro capsulation methods such as, for example, a coacervation method, interfacial polymerization method, inner polymerization method, phase separation method and outer polymerization method, using a solution prepared by dissolving an electron-donative color developing compound in a capsule oil.

As the wall film material of the microcapsule, there are listed, for example, polyurethane, epoxy resin, polyurea, urea-formaldehyde resins, melamine-formaldehyde resins, and the like.

As the electron-donative color developing compound, there are listed, for example, triarylmethane-based compounds, diarylmethane-based compounds, rhodamine-lactam-based compounds, fluoran-based compounds, indolyl phthalide-based compounds, pyridine-based compounds, spiro-based compounds, fluorene-based compounds, phenothiazine-based compounds and the like.

These electron-donative color developing compounds may be used alone or in combination of two or more.

As the capsule oil, there are listed, for example, cotton seed oil, castor oil, kerosene, paraffin, chlorinated paraffin, naphthene oil, alkylated biphenyl, alkylated terphenyl, alkylated naphthalene, diarylalkane, hydrogenated terphenyl, dialkyl phthalate and the like. These capsule oils may be used alone or in combination of two or more.

The color developing ink of the present invention contains the color developer composition of the present invention, photo-curable compound, photo-polymerization agent and pigment.

In the color developing ink of the present invention, the content of the color developer composition of the present invention is not particularly restricted, and in general, from 10 to 60% by weight, more preferably from 20 to 50% by weight.

Examples of the photo-curable compound used in the color developing ink include acrylate-based prepolymers and acrylate-based monomers such as epoxy acrylate, rosin-modified epoxy acrylate, polyester acrylate, polyurethane acrylate, polyether acrylate, alkyd acrylate, lauryl acrylate, 2-ethylhexyl acrylate, 2-hydroxyethyl acrylate, diethylene glycol dimethacrylate, diethylene glycol diacrylate, tricyclodecane dimethanol diacrylate, ethylene oxide-modified bisphenol F diacrylate, trimethylolpropane triacrylate and trimethylolethane trimethacrylate.

The content of the photo-curable compound in the color developing ink is not particularly restricted, and controlled, in general, from 20 to 90% by weight, more preferably from 30 to 80% by weight.

As the photo-polymerization agent, there are listed, for example, acetophenone derivatives, benzyl derivatives, benzoin derivatives, anthraquinone derivatives, oxime derivatives, xanthone derivatives, thioxanthone derivative, and the like.

The content of the photo-polymerization agent in the color developing ink is not particularly restricted, and in general, from 0.5 to 40% by weight, more preferably from 1 to 20% by weight.

As the pigment, there are listed, for example, titanium oxide, zinc oxide, calcium carbonate, aluminum hydroxide, barium sulfate, alumina white, kaolin, activated clay and the like.

The content of the pigment in the color developing ink is not particularly restricted, and in general, from 1 to 50% by weight, more preferably from 3 to 30% by weight.

The color developing ink of the present invention may also contain, for example, a polymerization inhibitor, dispersing agent, and further, the above-mentioned ultraviolet absorber, antioxidant, light stabilizer and the like, if necessary.

The color developing ink of the present invention can be prepared by mixing a color developer composition, photo-curable compound, photo-polymerization agent, pigment and others. In the mixing, there can be used a mixer such as, for example, an attritor and three-roll mill, if necessary.

The color developing ink of the present invention can form a layer containing the color developer composition of the present invention on a base material, to be used as a recording sheet.

For example, the color developing ink of the present invention can be printed on a base material such as paper, plastic sheet, synthetic paper, or composite sheets obtained by combining them, or on one surface of a base material carrying on the opposite surface thereof applied microcapsules containing therein an electron-donative color developing compound and a capsule oil, then, irradiated with lights for curing of the printed surface, giving a recording sheet.

As the printing method, there are listed, for example, an offset printing method and relief printing method, and the offset printing method is more preferable. As the light irradiation source, a mercury lamp and metal halide lamp can be used, for example.

When the color developing ink of the present invention is used, the amount of the color developing ink applied on a base material by printing is not particularly restricted, and in general, 0.5 $g/m^2$ or more, preferably from about 0.5 to 5 $g/m^2$, more preferably from about 1 to 3 $g/m^2$ in terms of the ink.

The following examples further illustrate the present invention in detail below, but do not limit the scope of the present invention. Hereinafter, % is by weight.

EXAMPLE 1

35 g of a zinc salt of 3,5-di(α-methylbenzyl)-salicylic acid and 5 g of polyhexamethylene carbonate diol having an average molecular weight of about 1850 (manufactured by EniChem, "RAVECARB®107") were dissolved in 40 g of 1,2-dichloroethane to prepare 80 g of a 1,2-dichloroethane solution.

Then, an aqueous solution of 1.4 g of polyvinyl alcohol (manufactured by Kuraray, Co., Ltd., Poval PVA205: product name) dissolved in 100 g of water was added to 80 g of the above-mentioned 1,2-dichloroethane solution, and emulsified and dispersed while stirring at a revolution of 10000 rpm using a homomixer (manufactured by Tokushu Kika Kogyo Co., Ltd.). The resulted emulsion was heated while stirring to distill off 1,2-dichloroethane, giving 92 g of an aqueous dispersion of a color developer composition (average particle size: 0.8 μm) of the present invention of a concentration of 45%.

EXAMPLE 2

An aqueous dispersion of a color developer composition having an average particle size of 0.7 μm was obtained according to the method described in Example 1, except that 38 g of a zinc salt of a polystyrenated salicylic acid resin produced in the following synthesis example and 2 g of polyhexamethylene carbonate diol having an average molecular weight of about 1850 (manufactured by EniChem, "RAVECARB®107") were used, instead of 35 g of a zinc salt of 3,5-di(α-methylbenzyl)salicylic acid and 5 g of polyhexamethylene carbonate diol having an average molecular weight of about 1850 (manufactured by EniChem, "RAVECARB®107"), in Example 1.

SYNTHESIS EXAMPLE 152 g (1 mol) of methyl salicylate, 37 g of 98% sulfuric acid and 500 g of 1,2-dichloroethane were charged into a glass reaction vessel, and to this solution was fed 312 g (3 mol) of styrene via a dropping funnel at 0 to 2° C. over a period of 6 hours while stirring the solution. After the feeding, the mixture was stirred for further 3 hours at the same temperature. The solution was neutralized with a 5% aqueous sodium hydroxide solution, then, heated to distill off 1,2-dichloroethane. Further, an aqueous solution of 40 g (1 mol) of sodium hydroxide dissolved in 1000 g of water was added to this, and the mixture was stirred for 6 hours at 95° C. To this solution was added 3000 g of water, then, an aqueous solution of 144 g (0.5 mol) of zinc sulfate 7-hydrate dissolved in 2000 g of water was added dropwise over a period of 1 hour at 25° C. The mixture was further stirred for 2 hours at room temperature, then, filtrated, washed with water and dried to obtain 460 g of a colorless zinc salt of a polystyrenated salicylic acid resin. The softening point was 134° C.

EXAMPLE 3

A mixture of 30 g of 3,5-di(α-methylbenzyl)salicylic acid and 10 g of 3-(α-methylbenzyl)-5-(1',3'-diphenylbutyl) salicylic acid was dissolved in an aqueous solution of 4.5 g of sodium hydroxide dissolved in 200 g of water, at 30° C. To this aqueous solution was added dropwise an aqueous solution of 16 g of zinc sulfate 7-hydrate dissolved in 80 g of water, over a period of 30 minutes. After the addition, the mixture was stirred for 30 minutes, then, the aqueous solution containing a precipitated mixed zinc salt of salicylic acid derivatives was filtrated, washed with water, and dried to obtain 42 g of a colorless mixed zinc salt of 3,5-di(α-methylbenzyl)salicylic acid and 3-(α-methylbenzyl)-5-(1', 3'-diphenylbutyl)salicylic acid.

32 g of a mixed zinc salt of 3,5-di(α-methylbenzyl) salicylic acid and 3-(α-methylbenzyl)-5-(1',3'-diphenylbutyl)salicylic acid and 8 g of polyhexamethylene carbonate diol having an average molecular weight of about 1850 (manufactured by EniChem, "RAVECARB® 107") were dissolved in 40 g of toluene, to prepare 80 g of a toluene solution.

Then, 80 g of the toluene solution was added to an aqueous solution of 2.0 g of polyvinyl alcohol (manufactured by Kuraray Co., Ltd., Poval PVA203: product name) dissolved in 100 g of water, and emulsified and dispersed while stirring at a revolution of 10000 rpm using a homomixer (manufactured by Tokushu Kika Kogyo Co., Ltd.). The resulted emulsion was heated while stirring to distill off toluene, giving 92 g of an aqueous dispersion of a color developer composition (average particle size: 0.7 μm) of the present invention of a concentration of 45%.

EXAMPLE 4

An aqueous dispersion of a color developer composition having an average particle size of 0.8 μm was obtained according to the method described in Example 1, except that 36 g of a zinc salt of 3,5-di(α-methylbenzyl)salicylic acid and 4 g of polyhexamethylene carbonate diol having an average molecular weight of about 1000 (manufactured by EniChem, "RAVECARB® 102") were used, instead of 35 g of a zinc salt of 3,5-di(α-methylbenzyl)salicylic acid and 5 g of polyhexamethylene carbonate diol having an average molecular weight of about 1850 (manufactured by EniChem, "RAVECARB®107"), in Example 1.

EXAMPLE 5

An aqueous dispersion of a color developer composition having an average particle size of 0.8 μm was obtained according to the method described in Example 1, except that 34 g of a zinc salt of a polystyrenated salicylic acid resin produced according to the method of the synthesis example and 6 g of polycaprolactone diol having an average molecular weight of about 1000 (polymer obtained by ring-opening of ε-caprolactone using neopentyl glycol as a initiator, manufactured by SOLVAY, "CAPA®214") were used, instead of 35 g of a zinc salt of 3,5-di(α-methylbenzyl) salicylic acid and 5 g of polyhexamethylene carbonate diol having an average molecular weight of about 1850 (manufactured by EniChem, "RAVECARB® 107"), in Example 1.

EXAMPLE 6

An aqueous dispersion of a color developer composition having an average particle size of 0.8 μm was obtained according to the method described in Example 3, except that 37 g of a mixed zinc salt of 3,5-di(α-methylbenzyl)salicylic acid and 3-(α-methylbenzyl)-5-(1',3'-diphenylbutyl) salicylic acid and 3 g of polycaprolactone diol having an average molecular weight of about 2000 (polymer obtained by ring-opening of ε-caprolactone using diethylene glycol as a initiator, manufactured by SOLVAY, "CAPA® 226") were used, instead of 32 g of a mixed zinc salt of 3,5-di(α-methylbenzyl)salicylic acid and 3-(α-methylbenzyl)-5-(1', 3'-diphenyl-butyl)salicylic acid and 8 g of polyhexamethylene carbonate diol having an average molecular weight of about 1850 (manufactured by EniChem, "RAVECARB®107"), in Example 3.

EXAMPLE 7

An aqueous dispersion of a color developer composition having an average particle size of 0.9 μm was obtained according to the method described in Example 1, except that 34 g of a zinc salt of 3,5-di(α-methylbenzyl) salicylic acid and 6 g of polycaprolactone diol having an average molecular weight of about 2000 (polymer obtained by ring-opening of ε-caprolactone using polytetramethylene ether glycol as a initiator, manufactured by Aldrich Chemical, "TERATHANE® C.L 2000" trademark of E.I. du Pont de Nemours & Co., Inc.) were used, instead of 35 g of a zinc salt of 3,5-di(α-methylbenzyl)salicylic acid and 5 g of polyhexamethylene carbonate diol having an average molecular weight of about 1850 (manufactured by EniChem, "RAVECARB® 107"), in Example 1.

EXAMPLE 8

An aqueous dispersion of a color developer composition having an average particle size of 0.9 μm was obtained according to the method described in Example 1, except that 36 g of a zinc salt of 3,5-di(α-methylbenzyl) salicylic acid and 4 g of polycaprolactone diol having an average molecular weight of about 2000 (polymer obtained by ring-opening of ε-caprolactone using polytetramethylene ether glycol as a initiator, manufactured by SOLVAY, "CAPA®720") were used, instead of 35 g of a zinc salt of 3,5-di(α-methylbenzyl) salicylic acid and 5 g of polyhexamethylene carbonate diol having an average molecular weight of about 1850 (manufactured by EniChem, "RAVECARB® 107"), in Example 1.

COMPARATIVE EXAMPLE 1

An aqueous dispersion of a color developer composition having an average particle size of 0.9 μm was obtained according to the method described in Example 1, except that the polyhexamethylene carbonate diol having an average molecular weight of about 1850 (manufactured by EniChem, "RAVECARB® 107") was not used, in Example 1.

COMPARATIVE EXAMPLE 2

An aqueous dispersion of a color developer composition having an average particle size of 0.8 μm was obtained according to the method described in Example 2, except that the polyhexamethylene carbonate diol having an average molecular weight of about 1850 (manufactured by EniChem, "RAVECARB® 107") was not used, in Example 2.

COMPARATIVE EXAMPLE 3

An aqueous dispersion of a color developer composition having an average particle size of 0.8 μm was obtained according to the method described in Example 3, except that the polyhexamethylene carbonate diol having an average molecular weight of about 1850 (manufactured by EniChem, "RAVECARBO 107") was not used, in Example 3.

COMPARATIVE EXAMPLE 4

An aqueous dispersion of a color developer composition having an average particle size of 0.8 μm was obtained according to the method described in Example 3, except that 37 g of a mixed zinc salt of 3,5-di(α-methylbenzyl)salicylic acid and 3-(α-methylbenzyl)-5-(1,3'-diphenylbutyl)salicylic acid and 3 g of stearic amide were used, instead of 32 g of a mixed zinc salt of 3,5-di(α-methylbenzyl)salicylic acid and 3-(α-methylbenzyl)-5-(1',3l-diphenylbutyl)salicylic acid and 8 g of polyhexamethylene carbonate diol having an average molecular weight of about 1850 (manufactured by EniChem, "RAVECARB® 107"), in Example 3.

COMPARATIVE EXAMPLE 5

An aqueous dispersion of a color developer composition having an average particle size of 0.9 μm was obtained according to the method described in Example 1, except that 34 g of a zinc salt of 3,5-di(α-methylbenzyl)salicylic acid and 6 g of polytetramethylene glycol having an average molecular weight of 1000 (manufactured by Merck KGaA, Polytetrahydrofuran 1000) were used, instead of 35 g of a zinc salt of 3,5-di(α-methylbenzyl)salicylic acid and 5 g of polyhexamethylene carbonate diol having an average molecular weight of about 1850 (manufactured by EniChem, "RAVECARB® 107"), in Example 1.

Composition ratios (ratio by weight) of color developer compositions produced in Examples 1 to 8 and Comparative Examples 1 to 5, and evaluations of dispersion stability measured according to the following method, are shown in Table 1.

Evaluation of dispersion stability of aqueous dispersion of color developer composition (Dispersion stability test)

Each 40 g (concentration: 45%) of the aqueous dispersion of each color developer composition produced in Examples 1 to 8 and Comparative Examples 1 to 5 was charged in a 50 ml glass sample bottle, allowed to stand still for 30 days at 40° C., and the precipitation proportion of each aqueous dispersion was measured. The precipitation proportion was calculated by dividing the height of a precipitate in the sample bottle by the height of the liquid surface, and multiplying the resulted value by 100. Lower the value of the precipitation ratio, the stability is more excellent. The results are shown in Table 1.

TABLE 1

| | Color developer composition Component (B)/component (A) (ratio by weight) | Precipitation proportion (%) |
|---|---|---|
| Ex. 1 | 14.3/100 | 1 |
| Ex. 2 | 5.3/100 | 1 |
| Ex. 3 | 25.0/100 | 2 |
| Ex. 4 | 11.1/100 | 1 |
| Ex. 5 | 17.6/100 | 2 |
| Ex. 6 | 8.1/100 | 1 |
| Ex. 7 | 17.6/100 | 2 |
| Ex. 8 | 11.1/100 | 2 |
| Comp. Ex. 1 | 0/100 | 15 |
| Comp. Ex. 2 | 0/100 | 10 |
| Comp. Ex. 3 | 0/100 | 11 |
| Comp. Ex. 4 | 0/100 (C: 8.1) | 12 |
| Comp. Ex. 5 | 0/100 (D: 17.6) | 6 |

C: Stearic amide
D: Polytetramethylene glycol (MW = 1000)

From these results, it is evident that an aqueous dispersion obtained by dispersing the color developer composition of the present invention shows little precipitation when allowed to stand still, and the water dispersion stability thereof is excellent.

Examples 9 to 16, Comparative Examples 6 to 10

The aqueous dispersions of the color developer compositions produced in Examples 1 to 8, Comparative Examples 1 to 5 were mixed with various materials in the following composition, to prepare coating solutions.

| | |
|---|---|
| 45% aqueous dispersion of color developer composition | 10 g |
| 69% aqueous dispersion of light calcium carbonate | 50 g |
| 20% water suspension of starch | 9 g |
| 50% aqueous dispersion of carboxy-modified SBR latex | 5 g |
| Water | 142.5 g |
| 20% Coating solution | 216.5 g |

This coating solution was applied on high quality paper (50 g/m$^2$) at a coated amount of in dry condition (weight of color developer composition layer or color developer layer) of 3.0 g/m$^2$, and dried to produce a pressure-sensitive recording sheet (lower sheet).

The pressure-sensitive recording sheets produced in Examples 9 to 16 and Comparative Examples 6 to 10, were evaluated according to the following method. The results are shown in Table 2.

Evaluation of pressure-sensitive recording sheet (Test of color developing property at lower temperature)

Each of the produced pressure-sensitive recording sheets (lower sheet), and a commercially available upper sheet to black development (manufactured by Mitsubishi Paper Mills, Ltd., N-40: Product Name) applied with microcapsules containing 3-N,N-diethylamino-6-methyl-7-anilinofluorane as the main electron-donative color developing compound, were stored for 24 hours in a chamber of constant temperature and constant humidity at 5° C. and 0°

C. and 30% (relative humidity). Then, the upper sheet and the lower sheet were laminated so that the applied surfaces thereof face with each other in this chamber of constant temperature and constant humidity, and a load pressure of 300 kg/cm$^2$ was applied for 1 second to cause color development.

After pressuring, the color developed concentrations of the recorded image after 5 seconds (measured only at 5° C.), 10 seconds and 24 hours were measured by using Σ80 color difference meter [manufactured by Nippon Denshoku Kogyo K.K.], and represented by Y value.

Regarding the color developed concentration of the recorded image, lower Y value means deeper color development.

TABLE 2

| | Color developed concentration (0° C.) | | Color developed concentration (5° C.) | | |
|---|---|---|---|---|---|
| | After 10 sec. (Y) | After 24 h. (Y) | After 5 sec. (Y) | After 10 sec. (Y) | After 24 h. (Y) |
| Ex. 9 | 48 | 31 | 58 | 45 | 30 |
| Ex. 10 | 49 | 32 | 60 | 48 | 31 |
| Ex. 11 | 47 | 33 | 58 | 46 | 32 |
| Ex. 12 | 49 | 31 | 58 | 47 | 30 |
| Ex. 13 | 47 | 33 | 56 | 46 | 32 |
| Ex. 14 | 49 | 32 | 58 | 48 | 31 |
| Ex. 15 | 49 | 33 | 59 | 46 | 32 |
| Ex. 16 | 46 | 32 | 56 | 46 | 31 |
| Comp. Ex. 6 | 76 | 31 | 81 | 71 | 30 |
| Comp. Ex. 7 | 77 | 33 | 81 | 74 | 32 |
| Comp. Ex. 8 | 77 | 32 | 82 | 72 | 32 |
| Comp. Ex. 9 | 74 | 33 | 80 | 62 | 32 |
| Comp. Ex. 10 | 58 | 33 | 70 | 50 | 32 |

From the results shown in Table 2, it is evident that a recording sheet obtained by applying a coating solution prepared by using an aqueous dispersion containing the color developer composition of the present invention develops deeper color in short period of time under lower temperature atmosphere.

EXAMPLE 17

To 36 g of a zinc salt of 3,5-di(α-methylbenzyl)-salicylic acid was added 4 g of polyhexamethylene carbonate diol having an average molecular weight of about 1850 (manufactured by EniChem, "RAVECARB® 107"), and the mixture was heated at 140° C. and mixed uniformly to obtain 40 g of a color developer composition of the present invention.

To this color developer composition of the present invention was mixed various materials in the following composition, and homogenized at 100 to 150° C. to prepare a color developing ink of the present invention.

| | |
|---|---|
| Color developer composition of the present invention | 28 g |
| Rosin-modified epoxy acrylate [Product Name: BANBEAM UV-22C, manufactured by Harima Chemicals, Inc.] | 17 g |
| Tricyclodecanedimethanol diacrylate [Trade Name: YUPIMER ® UV SA-1002, manufactured by MITSUBISHI CHEMICAL CORPORATION] | 44 g |

-continued

| | |
|---|---|
| 2,2-dimethoxy-2-phenylacetophenone [trade name: IRGACURE ® 651, manufactured by Chiba] | 4 g |
| Titanium oxide [trade name: TIPAQUE ® CR93, manufactured by Ishihara Sangyo Kaisha Ltd.] | 7 g |
| Color developing ink | 100 g |

For measuring the offset ink printing suitability of the produced color developing ink, the ink was printed on form paper (DIAFORM™manufactured by Mitsubishi Paper Mills Ltd.) at a basis weight of 2 g/m$^2$ using an offset printing machine (15% aqueous solution of isopropyl alcohol was used as wetting water, and water was fed by Dahlgren mode, and treated with an ultraviolet ray irradiation apparatus (high pressure mercury lamp) to dry the color developing ink, giving a recording sheet. Printing was conducted for 5000 meters, and stain of a water roller was observed to find no stain at all.

From these results, it is evident that the color developing ink produced by using the color developer composition of the present invention causes no stain on a water roller in offset printing, and has excellent offset printing suitability.

What is claimed is:

1. A color developer composition comprising (A) a color developer containing a polyvalent metal salt of a salicylic acid derivative, and (B) a polyester polyol having in the molecule skeleton at least one carbonate bond or ester bond, and a derivative thereof wherein the polyester polyol and derivative thereof is a polycarbonate diol or lactone-based polyester polyol.

2. The color developer composition according to claim 1 wherein the content of the component (B) is from 1 to 25 parts by weight based on 100 parts by weight of the component (A).

3. An aqueous dispersion of a color developer composition prepared by dispersing a color developer composition according to claim 2 in water.

4. A recording sheet obtained by applying on a base material a coating solution prepared by using an aqueous dispersion of a color developer composition according to claim 3.

5. A recording sheet having on a base material a layer containing a color developer composition according to claim 2.

6. A color developing ink comprising a color developer, photo-curable compound, photo-polymerizing agent and-pigment wherein the color developer is a color developer composition according to claim 2.

7. A recording sheet obtained by printing using a color developing ink according to claim 6 on a base material.

8. An aqueous dispersion of a color developer composition prepared by dispersing a color developer composition according to claim 2 in water.

9. A recording sheet obtained by applying on a base material a coating solution prepared by using an aqueous dispersion of a color developer composition according to claim 8.

10. A recording sheet having on a base material a layer containing a color developer composition according to claim 1.

11. A color developing ink comprising a color developer, photo-curable compound, photo-polymerizing agent and pigment wherein the color developer is a color developer composition according to claim 1.

12. A recording sheet obtained by printing using a color developing ink according to claim 11 on a base material.

13. A color developer composition comprising (A) a color developer containing a polyvalent metal salt of a salicylic acid derivative, and (B) a polyester polyol having in the molecule skeleton at least one carbonate bond or ester bond, and a derivative thereof wherein the content of the component (B) is from 1 to 25 parts by weight based on 100 parts by weight of the component (A).

14. An aqueous dispersion of a color developer composition prepared by dispersing a color developer composition according to claim 13 in water.

15. A recording sheet obtained by applying on a base material a coating solution prepared by using an aqueous dispersion of a color developer composition according to claim 14.

16. A recording sheet having on a base material a layer containing a color developer composition according to claim 13.

17. A color developing ink,comprising a color developer, photo-curable compound, photo-polymerizing agent and pigment wherein the color developer is a color developer composition according to claim 13.

18. A recording sheet obtained by printing using a color developing ink according to claim 17 on a base material.

* * * * *